United States Patent [19]

Uwe et al.

[11] 4,033,015

[45] July 5, 1977

[54] LOCK FOR A SAFETY BELT

[75] Inventors: Peters Uwe, Hamburg; Horst Minolla, Heidestieg, both of Germany

[73] Assignee: Klippan GmbH Hamburg, Hamburg, Germany

[22] Filed: Sept. 3, 1974

[21] Appl. No.: 503,009

[30] Foreign Application Priority Data

Nov. 15, 1973 Germany ..... 2356090

[52] U.S. Cl. ..... 24/230 AL

[51] Int. Cl.[2] ..... A44B 19/00

[56] References Cited

UNITED STATES PATENTS

| | | | |
|---|---|---|---|
| 3,693,221 | 9/1972 | Cunningham | 24/230 A |
| 3,728,764 | 4/1973 | Carter | 24/230 A |
| 3,851,360 | 12/1974 | Minolla | 24/230 AL |

*Primary Examiner*—Paul Gilliam
*Assistant Examiner*—D. Griffin
*Attorney, Agent, or Firm*—Jonathan Plaut

[57] ABSTRACT

Lock for a safety belt with a push-button and a slide in tongue arrangement, wherein the push-button cooperates with a guide part and they are formed of two separate elements, each provided with an inclined face.

5 Claims, 36 Drawing Figures

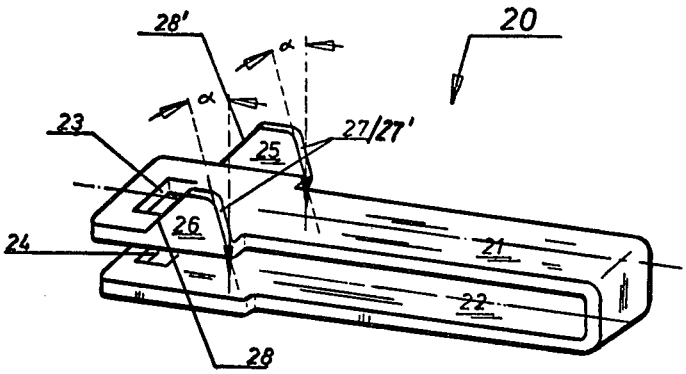
Fig. 1
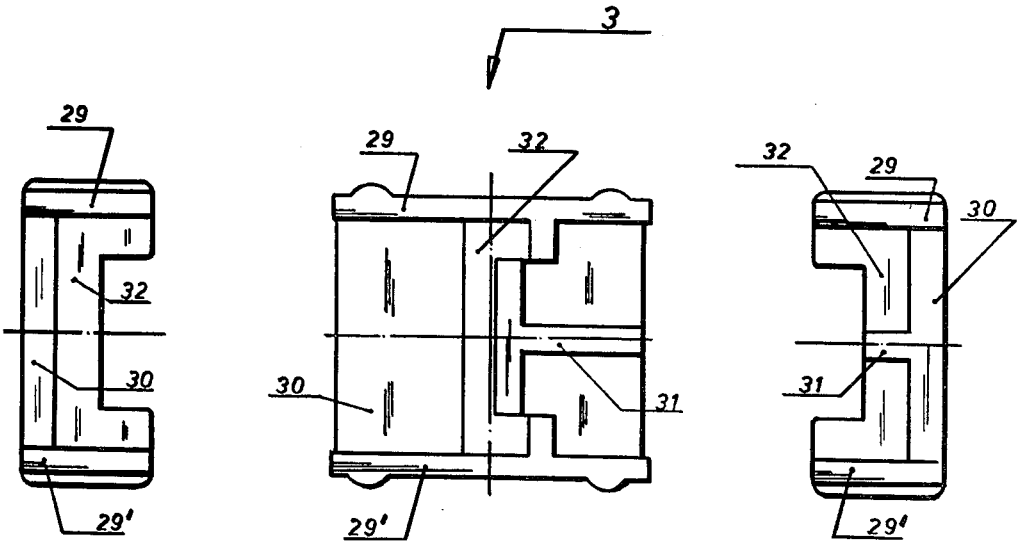
2a Fig. 2b 2c

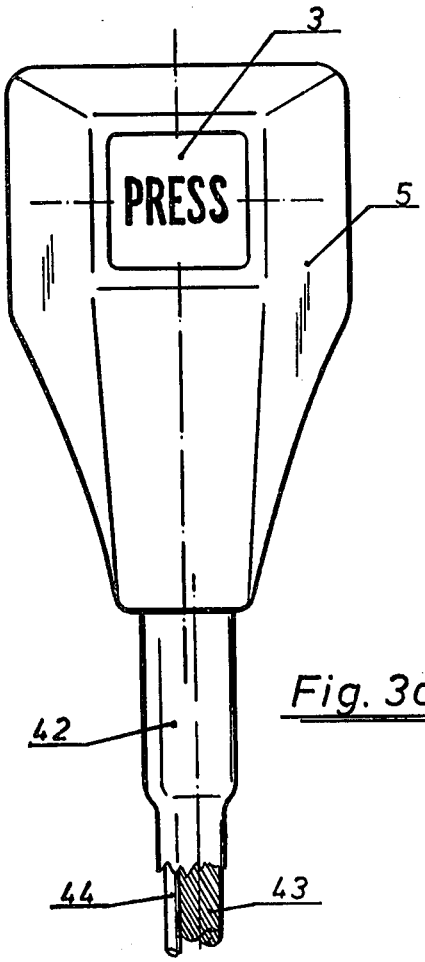
Fig. 3a
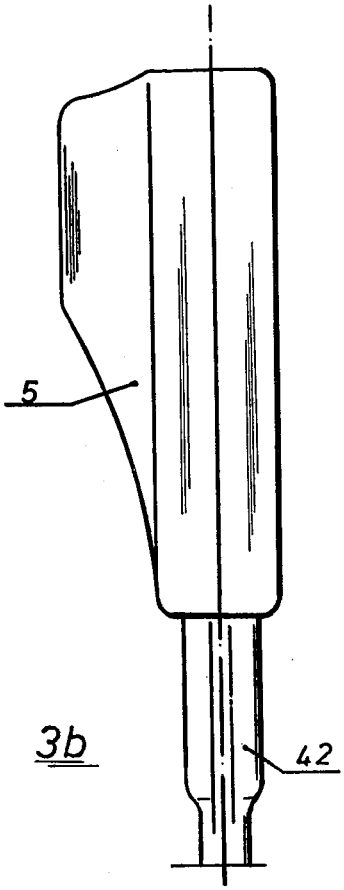
3b
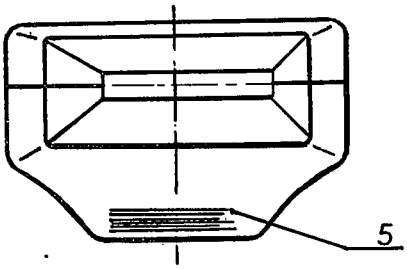
3c

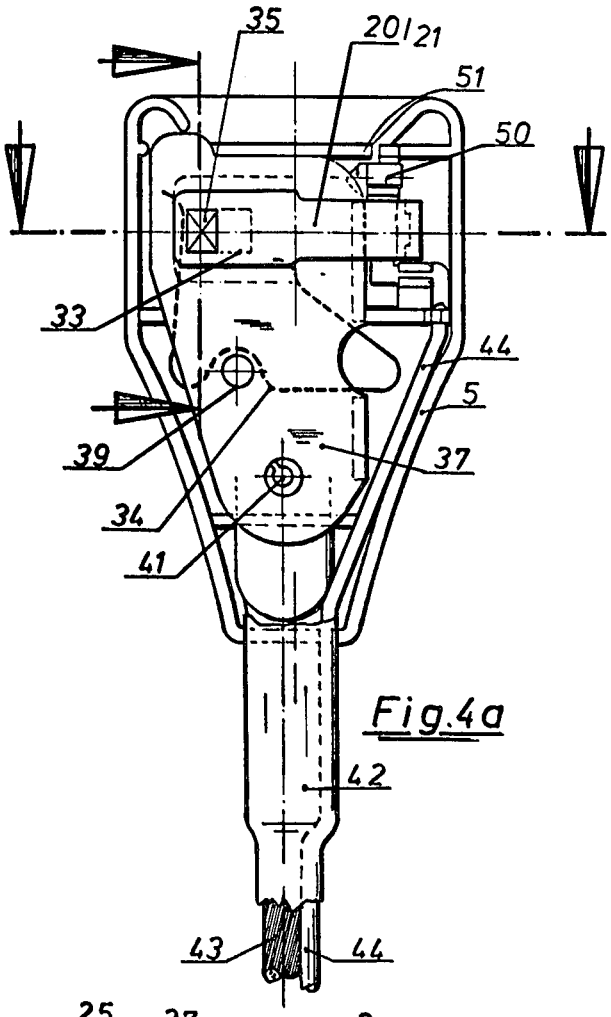
Fig.4a
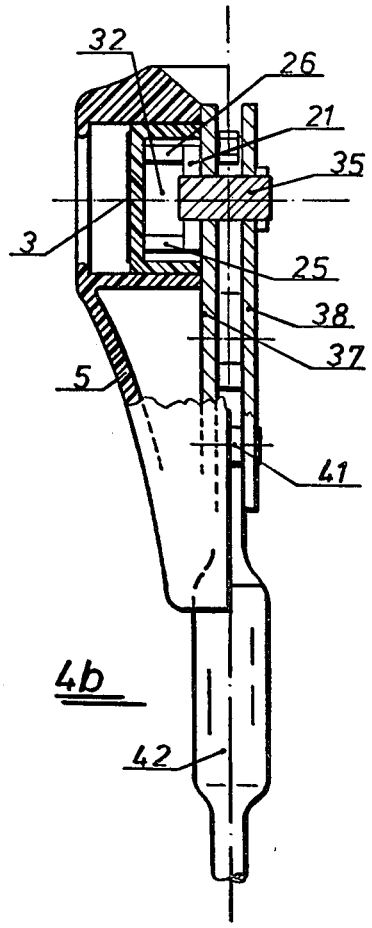
4b
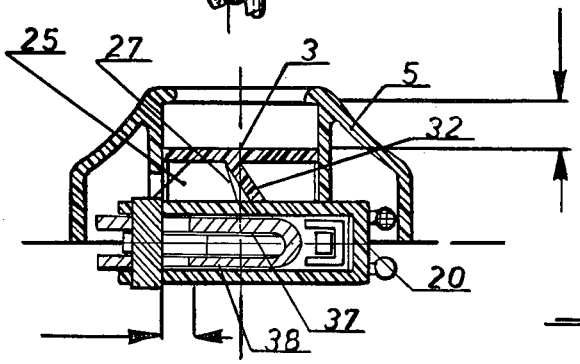
4c

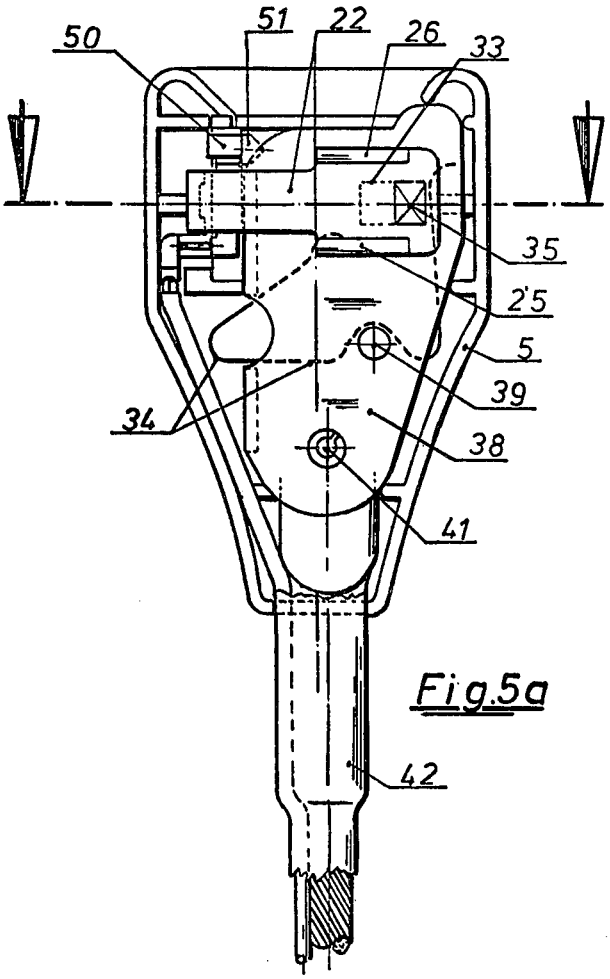
Fig.5a
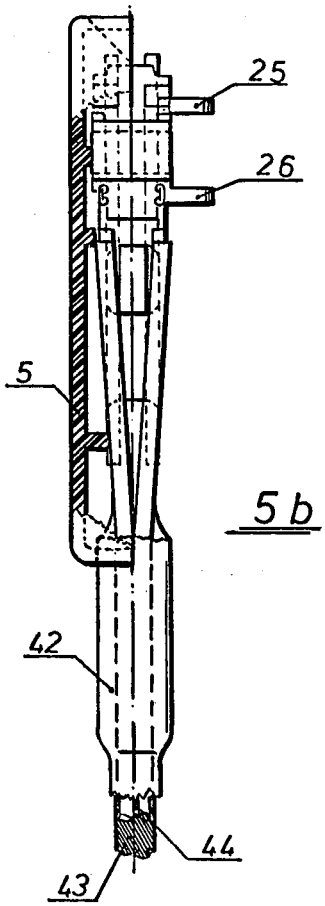
5 b
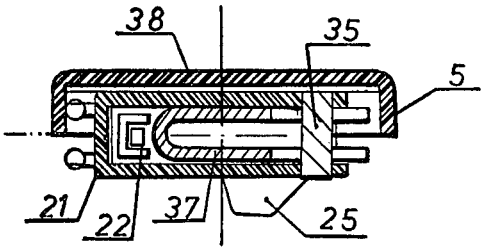
5 c

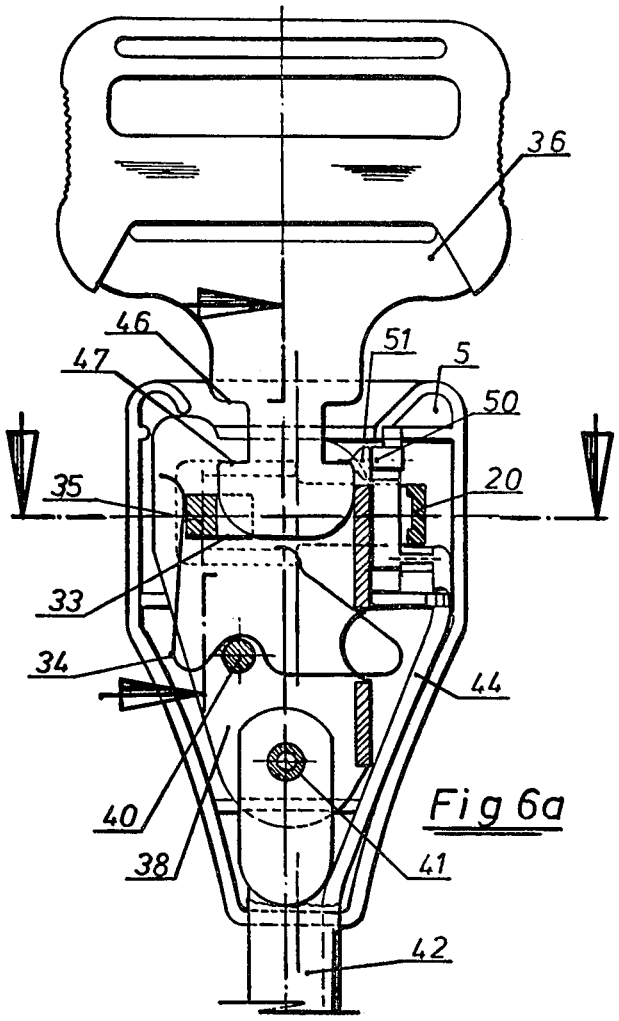
Fig 6a
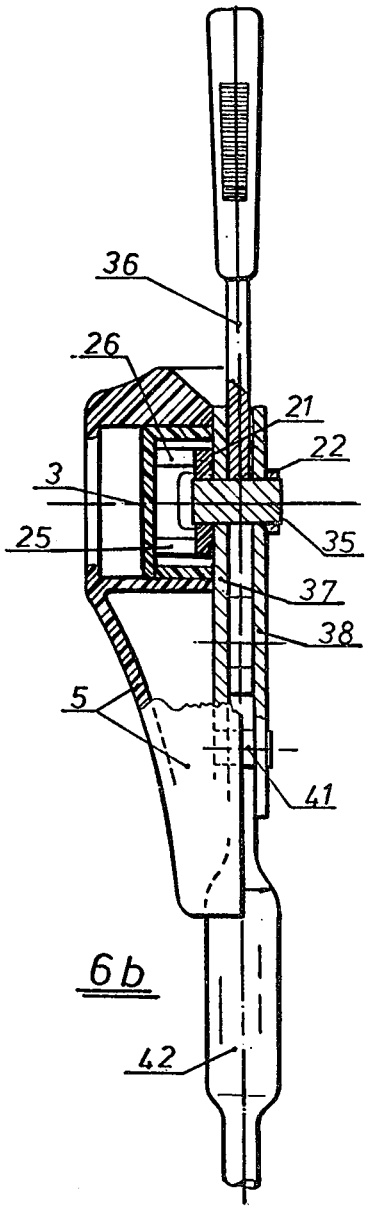
6b
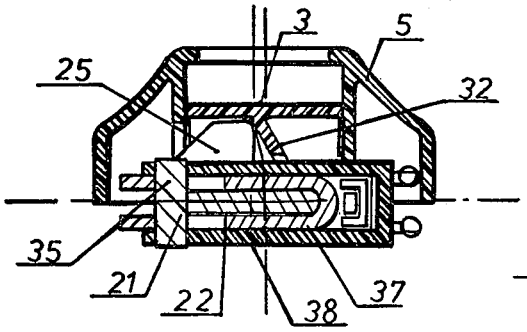
6c

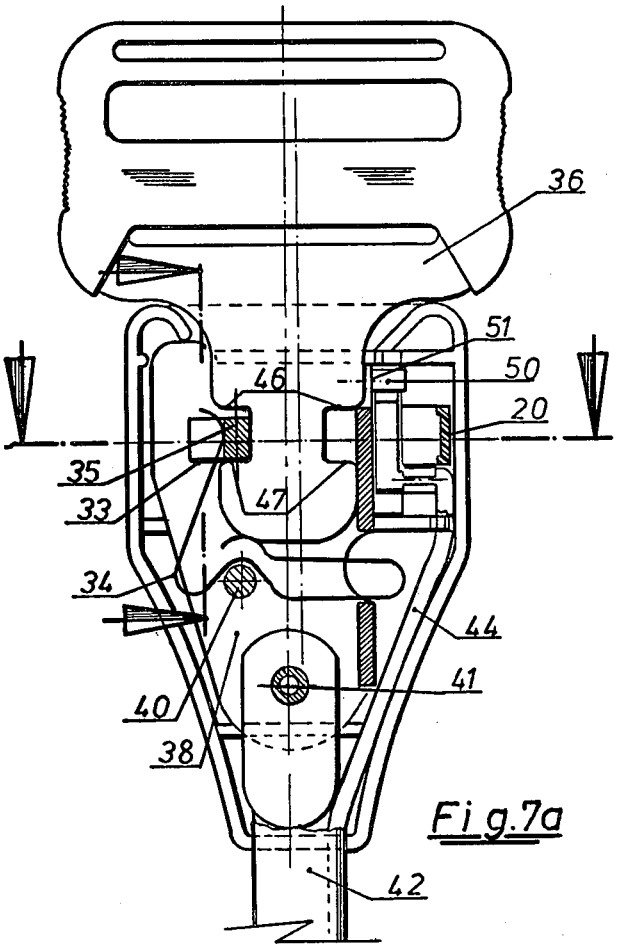
Fig.7a
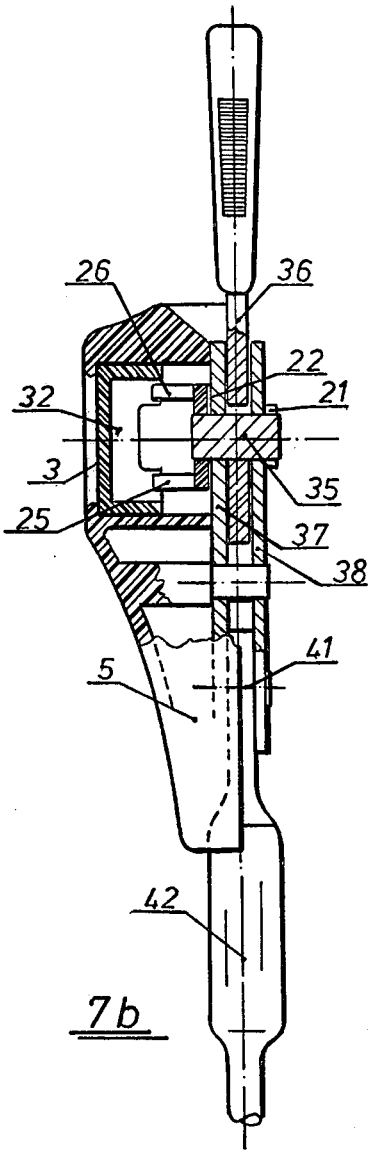
7b
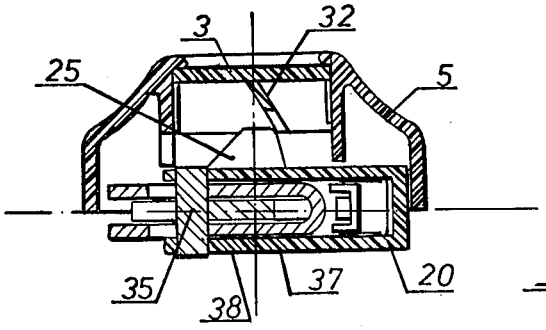
7c

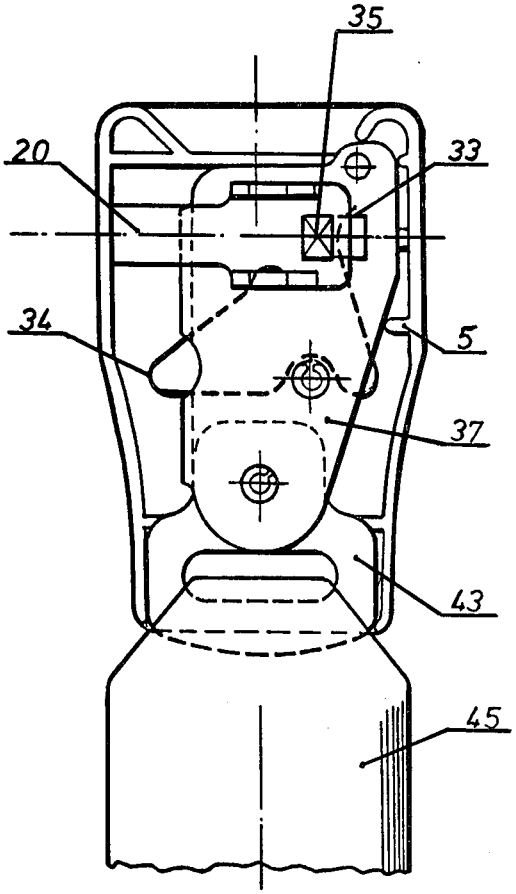
Fig.8a
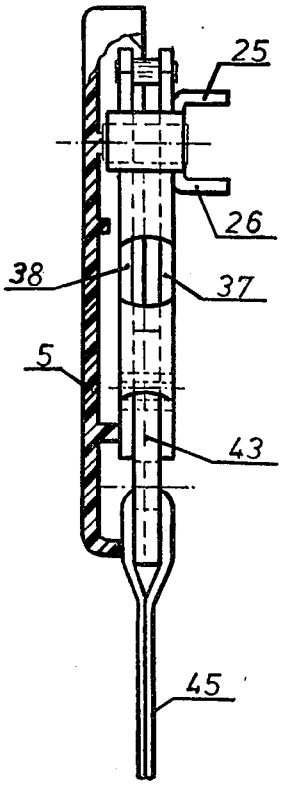
8 b

Fig. 11
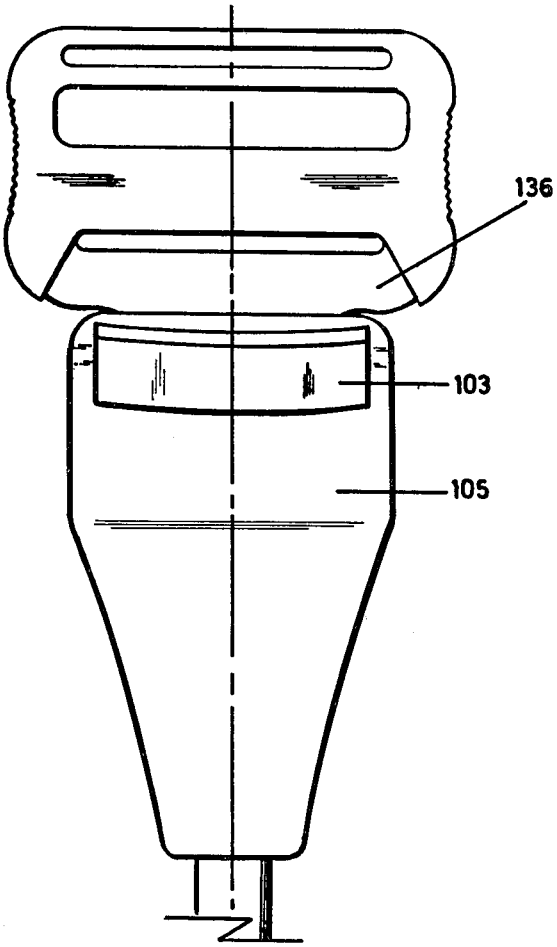
Fig. 12
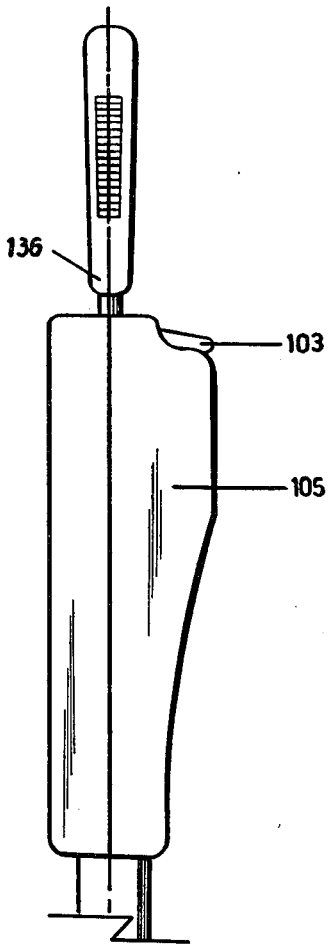
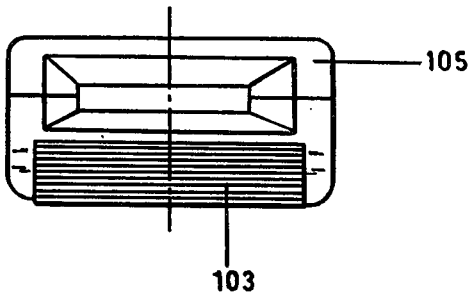
Fig. 13

Fig. 14
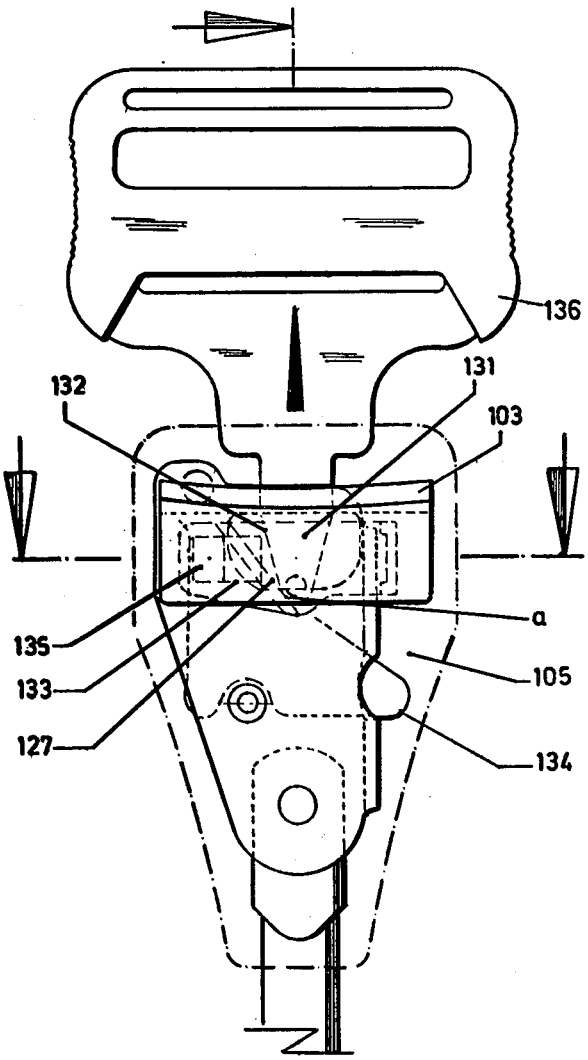
Fig. 15
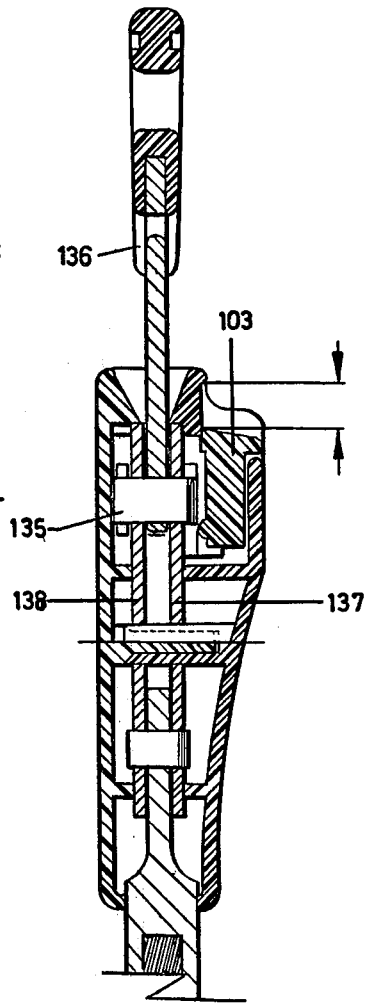
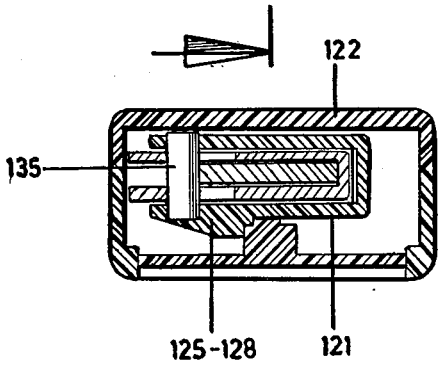
Fig. 16

Fig. 18
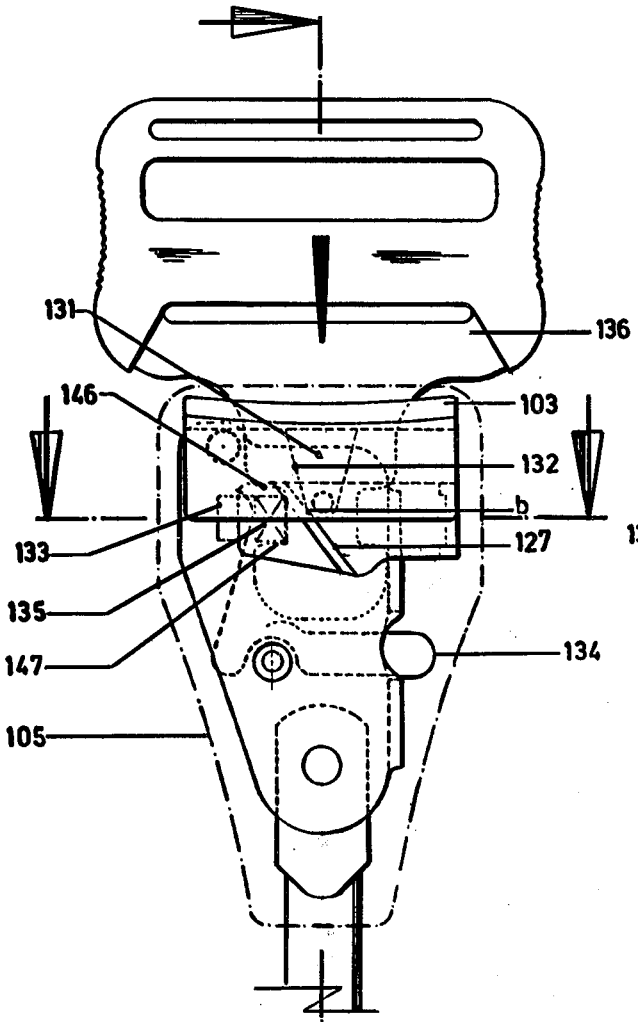
Fig 19
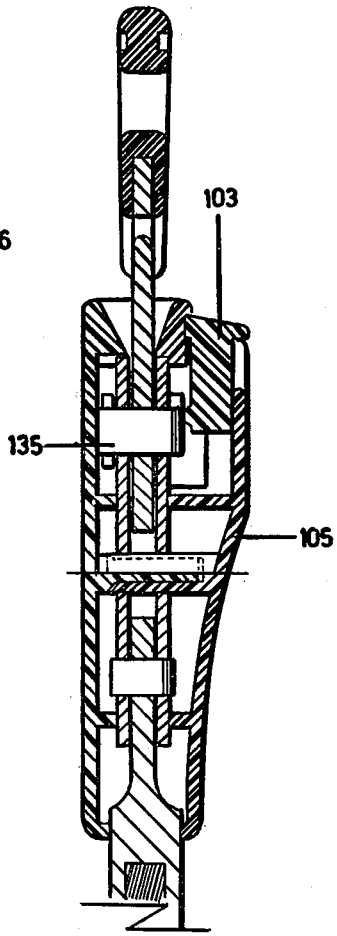
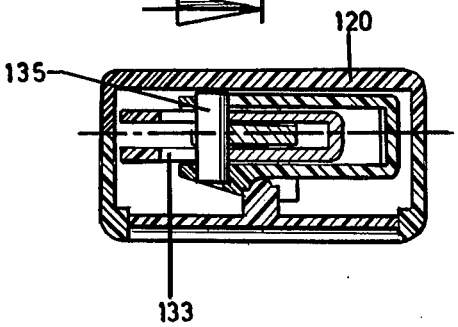
Fig. 20

LOCK FOR A SAFETY BELT

The invention concerns a lock for a safety belt, especially a vehicle safety belt, having a housing in which is provided a push-button for actuating a spring-biased bolt, there being provided in the housing at least one lock plate having a guide channel, the longitudinal axis of which extends transversely to the direction in which a plate-like slide-in tongue with lateral locking notches slides, the bolt being movable in the guide channel and being directly connected to a guide part, which has two limbs which are disposed on the outer faces of the lock plate and are firmly connected to the bolt, and the faces of, on the one hand, the locking notches on the slide-in tongue and of, on the other hand, the bolt, which bear against each other in the locking position, being disposed obliquely in relation to the longitudinal central axis of the slide-in tongue.

A lock for a safety belt of the above-described kink is disclosed in German Patent Offenlegungsschrift 2,109,460. The purpose of this arrangement was to provide a narrow housing that is very shallow and composed of only a few parts. If the user of the known lock is involved in an accident, this may have the undesirable result that the lock is unintentionally opened by objects flying about and happening to strike the push-button. On the other hand the belt lock is intended to be readily released in a dangerous situation, e.g. in the event of fire breaking out. In the known construction this object is achieved in that the locking notches on the slide-in tongue on the one hand and the faces of the bolt that bear against these notches in the locking position on the other hand are disposed obliquely in relation to the longitudinal central axis of the slide-in tongue. The term "obliquely" here means at an angle of a few degrees, e.g. 7°, to the normal on the longitudinal central axis of the slide-in tongue. usually the plate-like slide-in tongue for the locking mechanism is provided with notches of substantially rectangular form at its two opposite lateral edges. The mouths of these notches thus face the outside edges. A bolt displaceable in the lock housing can be moved into these notches to achieve a connection, coupling or locking engagement wherein the parts involved are in substantial mating relationship with each other. To ensure that the connection of coupling remains reliable and effective in the event of tensioning of the belt during which the slide-in tongue tends to pull out of the belt lock, the locking notches must have faces in the direction of the normal to the longitudinal central axis of the slide-in tongue, since the tensile forces set up when an accident occurs act at right-angles thereto. This requirement must be met to ensure safety.

On the other hand, to enable the belt lock to readily be opened after an accident, i.e., to permit the slide-in tongue to be withdrawn from the lock, the interengaging faces on the bolt and in the locking notches have been slightly inclined in relation to the said normal, but it is necessary to limit the angle of inclination to a few degrees. This inclination creates a kind of wedge effect whereby it becomes easier to press the bolt out of the recesses constituted by the locking notches.

If it is required further to improve and facilitate uncoupling and therefore the disengagement of the bolt from the locking notches of the slide-in tongue, the prescribed angle of a few degrees to the normal to the longitudinal central axis of the slide-in tongue should not be increased but instead other means should be looked for, and it is the purpose of the present invention to provide such means.

Thus, the object of the invention is to provide an improved belt lock of the initially stated kind so that the force applied to the push-button for releasing the slide-in tongue from the belt lock or for pressing the bolt out of the locking notches is reduced, and the push-button is arranged to enable it to be operated in the best possible manner.

According to the invention, this object is achieved in that the push-button and the guide part are formed as two separate elements which are each provided with an inclined face which slopes towards the longitudinal axis of the guide channel, the inclined face on one of the elements being presented to the inclined face on the other. Thus, for the purpose of reducing the force expended in depressing the push-button, a double wedge arrangement is provided. One of the wedges is the above described angle on the locking groove of the slide-in tongue and on the bolt, as present in the known belt lock; in addition however, a second wedge effect is created by the very simple means proposed in accordance with the invention. The device in accordance with the invention has been tested many times for reliability and has proved successful. The inclined face on the push-button slides off the inclined face of the guide part when the push-button is depressed and sets up a force component which extends transversely to the direction in which pressure is applied and which ensures displacement of the guide part and thus movement of the bolt in the longitudinal channel.

A further advantage results from the following: since the above-mentioned lock plate in the housing of the belt lock generally takes the form of a flat planar element, and the slidein tongue is to be disposed parallel to this plane, the deflection of the force for moving the guide part parallel to this lock plate in an operating direction at right-angles to said plate enables the belt lock to be turned through 90°, so that the push-button can be fitted at the side, i.e., can be positioned to face the user as he gets into the vehicle, so that he observes the push-button immediately. In addition the lock can be operated more conveniently since the user presses the button from the side with his thumb in a convenient manner. it should be explained that the lock plate and the plate-like slide-in tongue are therefore disposed as nearly as possible in the vertical plane, since the belt can then be laid flat on the body of the user without being twisted.

The provision of the push-button at the side of the lock leads to the further advantage that it is in a safer position since objects flying about during an accident cannot strike the push-button and inadvertently open the belt lock. The forces due to the mass of the push-button itself also occasionally play a part. If the push-button is able to move transversely to the direction of the acceleration forces occurring when an accident takes place, inadvertent opening of the belt lock clearly cannot occur.

A particularly practical form of construction is achieved by providing two spaced lock plates of the same shape, in each of which the guide channel is formed at the required place. The bolt then extends through both plates and can be expediently pushed into and withdrawn from the locking notches of the slidein tongue inserted between these two plates. The two similarly shaped lock plates can also be secured to each other by forming both halves by bending over a single symmetrical part. These then form a U-shaped cross-section, and the two limbs of the U constitute the two lock plates.

Also according to the invention, the guide part has, on that of its faces presented to the push-button, two walls which project from one of the limbs, a narrow edge of each wall that is disposed opposite the bolt, being formed as an inclined face. This arrangement saves material and, as extensive tests have shown, provides absolute functional safety accompanied by a reliable action and a lengthy service life.

In accordance with the invention, the same advantages are obtained if the push-button has two guide walls extending into the housing and disposed parallel to the longitudinal axis of the guide channel, between which walls is provided an inclined face which is additionally supported on the base of the push-button and which slopes towards the longitudinal axis of the guide channel. The two inclined faces described slide one over the other when the push-button is depressed, and as a result of the known wedge effect they deflect the force through 90° so that the bolt can be moved in the required manner in a direction transverse to the lock plate or plates. A narrow spring strip bears on one side of the bolt so that the latter is continuously pressed into the locking position. The slide-in tongue is provided in known manner with a rounded or inclined face which, when the slide-in tongue is inserted, presses the bolt outwards to overcome the force of the spring. When the slide-in tongue is fully inserted, the bolt then drops automatically into the locking notches, i.e., into the above-described recesses, under the effect of the spring force. The locking action is then completed. Expediently, the spring strip is made in one piece and is so formed that its other end acts as an ejection spring and presses against the front side of the slide-in tongue and ejects the latter from the belt lock after the bolt has been withdrawn from the locking position.

In accordance with a further advantageous feature of the invention, the guide part and/or the push-button are made of plastics material. Polyamide 6 is particularly suitable for the purpose. The housing, which surrounds the lock plate and the push-button, can likewise be made of plastics material. Particularly suitable for this purpose is polycarbon which is commercially available under the trade name Makrolon.

The invention provides two further considerable advantages: the first of these is that the use of two wedge combinations permits wider manufacturing tolerances, and the quality of the belt lock can be considered as remaining constant as called for in the national standards relating to locks and fasteners. On the other hand, the wider manufacturing tolerances that are possible enable the stamping tools, particularly those used for forming the plate-like slide-in tongue, to be used over longer periods. If, because of wear of the tools, the size of one of the wedges on the slide-in tongue or its locking notches changes somewhat, the effect can be fully taken up by the other wedge arrangement.

The second advantage resides in the not inconsiderable saving in space within the housing of the belt lock as compared with the initially described known arrangement. The space at the side of the lock plates in the housing that is necessary in the known belt lock for permitting the stroke of the push-button is available for accommodating a switch which, in a vehicle, can be used for indicating whether the slide-in tongue is or is not latched in the lock.

Furthermore, the lock of the invention and its components, especially the guide part and the push-button, can be small and therefore inexpensive to produce.

Another arrangement, whereby the push-button can be actuated from the front as seen from the instrument panel of the vehicle, is characterized in that the guide part has, on that of its sides facing the push-button and in the zone where the bolt is secured, a ramp part which extends from the free end of the guide part to approximately the middle and which is delimited towards the middle by a face which is inclined with respect to both the longitudinal axis of the guide channel and the direction in which the slide-in tongue is inserted. Some automobile manufacturers require the push-button to be actuated from the front, i.e., to be moved towards the rear of the vehicle, instead of from the side as described in connection with the arrangement dealt with above. When a collision occurs, movable parts are flung in the opposite direction in the interior of the vehicle, i.e., are flung forwardly since braking causes these parts to continue to move in the direction in which the vehicle is travelling. The advantageous arrangement of the push-button at the front of the belt lock is prevented, with greater certainty, from being inadvertently actuated. In this embodiment, the transmission of the movement through the wedge action, instead of taking place from the side in the direction of the longitudinal axis of the guide channel, now occurs from the front in the direction in which the slide-in tongue is inserted and again towards the longitudinal axis of the guide channel. The two inclined faces or wedge faces must therefore be displaced in their function through 90° from those of the previously described arrangement.

For this purpose the push-button is advantageously of substantially L-shaped cross-section and has, on that side facing the interior of the housing, an arm having a wedge face disposed to correspond with the inclined face of the guide part. This arrangement is still simpler and strong and offers all the above-mentioned advantages of the previously described belt lock.

Further advantages, features and applications of the invention will be seen from the following description relating to the annexed drawings, in which:

FIG. 1 is a perspective illustration of the guide part;

FIGS. 2*a*, 2*b* and 2*c* are a plan view and side views, from the front and rear, of the push-button;

FIGS. 3*a*, 3*b* and 3*c* are exterior views of the belt lock without the slide-in tongue;

FIGS. 4*a*, 4*b* and 4*c* show, partly in section, the belt lock in the released condition wherein the push-button is in the lower position;

FIGS. 5*a*, 5*b* and 5*c* are similar illustrations of the belt lock but from the other side;

FIGS. 6*a*, 6*b*, and 6*c* are similar illustrations of the belt lock with the slide-in tongue inserted;

FIGS. 7*a*, 7*b* and 7*c* are similar illustrations of the belt lock after the slide-in tongue has been pushed in and locked, the push-button being in the upper position;

FIGS. 8*a* and 8*b* show another form of construction of belt lock with means for securing it to the belt;

FIGS. 11 and 12 are a plan view and side view respectively of the belt lock together with the slide-in tongue;

FIG. 13 is a front view of the belt lock without the slide-in tongue;

FIG. 14 shows, partly in section, the belt lock in the released condition wherein the push-button is in the rear, i.e. the depressed position;

FIGS. 15 and 16 are a sectional side view and front view respectively of the belt lock in the same condition as in FIG. 14;

FIGS. 18, 19 and 20 show the belt lock with the locked slide-in tongue, in plan view and in section.

Figure 9:
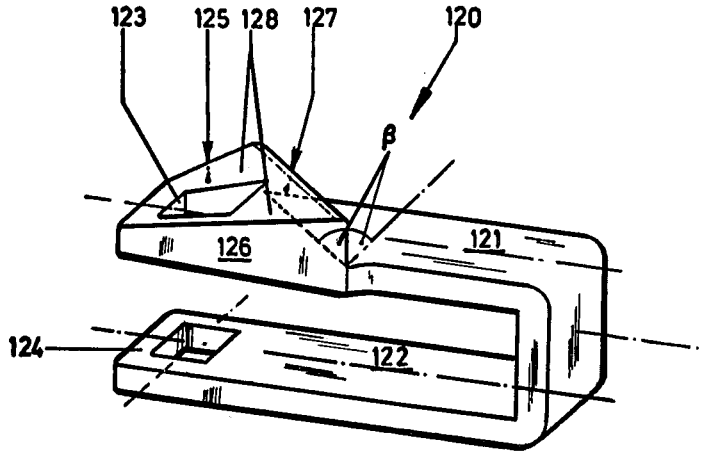
FIG. 9 is a perspective illustration of the guide part of the second construction in accordance with the invention.

FIG. 1 shows the guide part 20 which is of U-shaped cross-section or is formed like a box with two flat limbs 21 and 22. At the front end of each limb is formed an opening 23, 24 in which the bolt 35 can be secured. Two walls 25 and 26 project from one limb 21 on that face thereof associated with the pushbutton 3, and a narrow edge of each of these walls that is disposed opposite the bolt 35 is formed as an inclined face 27, 27'. These inclined faces form, with the normal, an angle $\alpha$. In each case this angle is represented by the broken lines, and that broken line provided with an arrow represents the direction of the normal. The other inclined face 28, 28' of each of the walls is provided simply because of the inclined face of the housing 5.

Various views of the push-button 3 are shown in FIGS. 2*a*, 2*b* and 2*c*. The view from above is not technically important and can be seen from FIG. 3*a*. FIG. 2*b* however shows a view of the push-button from below, FIG. 2*a* is a view from the left of the FIG. 2*b* position, and FIG. 2*c* a view from the right of the FIG. 2*b* position. FIG. 2*b* clearly shows the two guide walls 29 and 29' between which is provided an inclined face 32 supported on the bottom 30 of the push-button by way of a rib 31.

FIGS. 4*b* and 4*c* show the arrangement of the push-button 3 in the housing 5 of the belt lock. The longitudinal central axis of the belt is shown as a chain-dotted line, and the guide channel 33 is disposed at right-angles thereto, i.e., is normal thereto. The inclined face 32 on the push-button 3 as well as the inclined faces 27 and 27' respectively on the projecting walls 25 and 26 of the guide part 20 extend in the direction of the longitudinal central axis of the guide channel 33. It will be seen from FIG. 4*c* that in the particular arrangement illustrated in the drawings, the angle of the inclined face 32 is steeper with respect to the vertical central axis than is the angle of the inclined faces 27 and 27' of the guide part 20. In each case however a wedge effect is achieved, and when the push-button 3 is depressed, the inclined face 32 pushes the guide part 20 to the left into the position shown in FIGS. 4*a* and 4*b*.

FIGS. 5*a*, 5*b* and 5*c* show this position as seen from below. Here the guide part 20 is of course pushed to the right.

A spring strip 34, bent roughly to the shape of a U presses by one of its ends against the bolt 35 disposed in the guide channel 33 in the guide part 20, whereas its other end acts as an ejector and presses against the front end of the slide-in tongue 36 shown in FIGS. 6 and 7. This last-mentioned end of the spring 34 is shown in FIGS. 4 and 5 in the unloaded, untensioned condition. The spring 34 is arranged between two lock plates 37 and 38 which are formed from a single piece of strip bent into the form of a U. The two lock plates are held apart at their free ends and below their middle by studs, and each has a hole 39 through which a pin 40, provided on one half of the housing 5, can be pushed so that it is embraced on one side by the semi-circular curve in the spring 34. In this way the spring is also firmly held. Fitted on the lower stud 41, which is secured by a circlip, is a shrunk-on tube 42 or, in the arrangement shown in FIGS. 8*a* and 8*b*, a shackle. The tube contains a flexible lower part 43 for attaching the belt lock to the floor of the vehicle, and an electric cable 44 for an electric switch to be described later, whereas in the arrangement shown in FIGS. 8*a* and 8*b*, a belt end 45 is attached to the lower part 43 likewise for securing the belt lock to the chassis of the vehicle.

FIGS. 6 and 7 show the plate-like slide-in tongue 36 which has lateral recesses acting as locking notches 46 and 47. The notch 47 is inclined at an angle of a few degrees, 7° in the example shown, to the normal on the longitudinal axis of the belt lock which is disposed in the direction of the longitudinal axis of the guide channel 33. The corresponding engaging face of the bolt 35 has the same angle of inclination so that, in the locking position shown particularly clearly in FIG. 7*a*, the two faces bear against each other and a good locking action or coupling is achieved for securing the flexible lower part 43 or the belt 45 and the slide-in tongue 36 on the other side.

In the FIG. 6*a* illustration, the slide-in tongue 36 has not yet been latched in, but is in that position in which it is just inserted into the belt lock and, by its rounded forward end, pushes the bolt 35 outwards along the guide channel 33 against the tension of the spring 34. It is guided between the two lock plates 37 and 38 and at right-angles thereto by the web connecting the two lock plates, and at the opposite side by the bolt 35. After the slide-in tongue 36 has been pushed further in against the pressure of the spring 34, it reaches its end position, and the bolt 35 is pressed by the force of the spring 34 into one of the lateral recesses and moves out of the belt lock towards the locking notch 47 when pull is exerted by the slide-in tongue 36.

On the right of the belt lock as seen in FIGS. 4*a*, 6*a* and 7*a* is the above-mentioned switch 50, the plunger 51 of which is depressed by the narrow side of the slide-in tongue 36 when the latter is pushed in, the plunger thus establishing a connection between two electric leads in the cable 44. A circuit is then closed and this has the effect of switching off a warning device (buzzer or lamp) on the instrument panel of the vehicle. The user then knows that the slide-in tongue 36 has been inserted and correctly fitted in the belt lock. In the contrary case, the lamp or buzzer warns the user that he has to strap himself in.

Release or uncoupling is carried out in the following manner.

Pressure on the push-button 3, which is in the position shown in FIGS. 7*b* and 7*c*, causes displacement to the left of the wedging inclined faces 27, 27' of the walls 25 and 26 respectively of the guide part 20, i.e., moves these faces against the force of the spring 34, the bolt 35 being moved in the guide channel 33 from the position seen in FIG. 7*a* into the position shown in FIG. 6*a*. The force required for depressing the push-button is reduced by the wedge arrangement of the inclined faces 32 and 27, 27' on the guide part on the one hand and the inclined sides of the locking notches 47 and the corresponding engagement face of the bolt on the other. After the bolt has reached the position shown in FIG. 6*a*, the slide-in tongue is ejected by the pressure applied by the ejection spring.

The second form of construction is illustrated in FIGS. 9 to 23. Fig. 9 again shows the guide part 120 which is of U-shaped cross-section or shaped like a box and has two flat limbs 121 and 122. The front end of each limb has an opening 123 and 124 respectively in which the bolt 135 can be secured. From that side of one limb 121 that is associated with the push-button 103 there projects a ramp part 125 to 128 which is disposed in the zone in which the bolt is secured, said ramped part extending from the free end of the guide part (on the left in FIG. 9) to approximately the middle. Towards the middle the ramped part is delimited by a face 127 which is inclined with respect to both the longitudinal axis of the guide channel 133 and to the direction in which the slidein tongue 136 is inserted. The slope of this inclined face is indicated by the angle $\beta$ in FIG. 9. The only reason for the part comprising the inclined face 127 being ramped in such manner that the low part is provided on the free end of the guide part and the high part approximately at the middle is that the housing 105 has an inclined surface.

Figure 10:
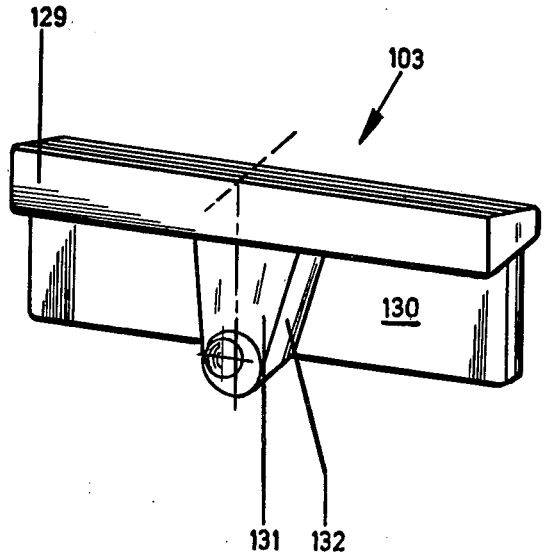
FIG. 10 is a perspective illustration of the push-button.

The push-button 103 is shown in perspective in FIG. 10. It is L-shaped in cross-section. one limb of the L may be referred to as the base 130 of the push-button and the other as the finger piece 129. The FIG. 10 view is from the interior of the housing. An arm 131 with a wedge face 132 can be clearly seen. The wedge face 132 cooperates with the inclined face 127 when the belt lock is being operated. Although the two faces 127 and 132 do not have to have the same angle of slope, they must however extend in the same direction so that when the push-button 103 is pressed downwards and to the left, as seen in FIG. 9, on to the inclined face 127, it is able to deflect to the left (FIG. 9).

FIGS. 11, 12 and 13 are views from the exterior of the belt lock with the slide-in tongue in the locked position. The arrangement and position of the push-button 103 are seen at the front end which faces the instrument panel. The push-button is marked with a red luminescent colour and this makes it easier for the user to unlock the device in an emergency.

The arrangement shown in FIGS. 14, 15 and 16 is of greater technical interest. The arrangement of the push-button 103 is illustrated therein, and the longitudinal axis of the guide channel 133 and the direction in which the slide-in tongue is pushed in are both shown by chain-dotted lines. The position of the inclined face 127 of the ramped part is clearly shown by the broken line in FIG. 14. The broken line indicating the wedge face 132 is more steeply inclined than the broken line indicating the surface 127. In this arrangement the arm 131 is shaped approximately like a V. It will be seen that in the position illustrated in FIGS. 14 to 16, the push-button 103 is. pressed rearwards against the force of the spring 134 and that at the bottom the wedge face 132 engages the inclined face 127 of the guide part at the point designated by the letter *a*. The bolt 135 is thus displaced leftwards in the guide channel 133 against the force of the spring. The slide-in tongue is disengaged and can be withdrawn.

The precise arrangement of the ejector spring 134 and the lock plates 137 and 138 and the method of securing the cable doe not need to be dealt with in detail here since the construction is similar to that used in the first embodiment illustrated in FIGS. 1 to 8.

Figure 17:
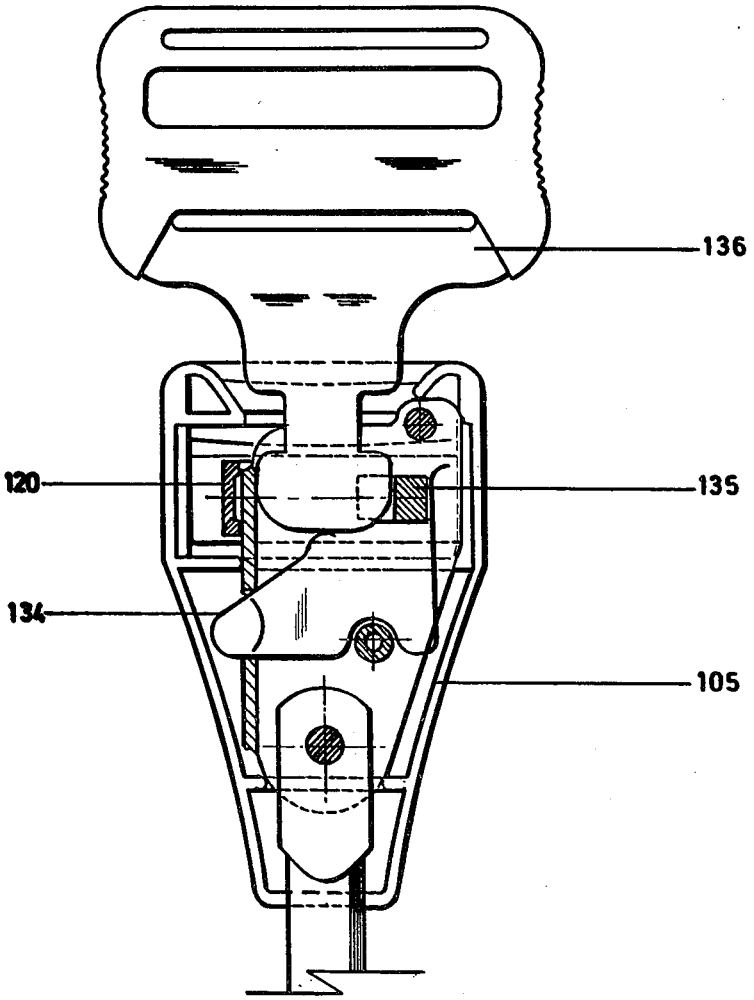
FIG. 17 is a sectional view from below of the belt lock with the slide-in tongue released.

FIG. 17 is an underneath view, partly in section, of the belt lock. Here the bolt 135 is shown as pushed to the right and the slide-in tongue is therefore released.

FIGS. 18 to 20 on the other hand illustrate the locked position. The bolt 135 is on the right side of the guide channel 133 and engages in the recess 146, 147 in the slide-in tongue 136 and locks the latter. The push-button 130 is not actuated and therefore projects forwardly by the length of its stroke, in contrast to the arrangement seen in FIG. 15. The wedge face 132 on the arm 131 bears on the inclined face 127 of the guide part at a point designated *b* in FIG. 18. If the push-button 103 were depressed, the wedge face 132 and thus the arm 131 would move downwards in the insertion direction along the chain-dotted line, and the guide part, because of the wedging function of the inclined face 127, is only able to deflect to the left, so that the bolt 135 would be pushed to the left in the guide channel 133.

Figure 21:
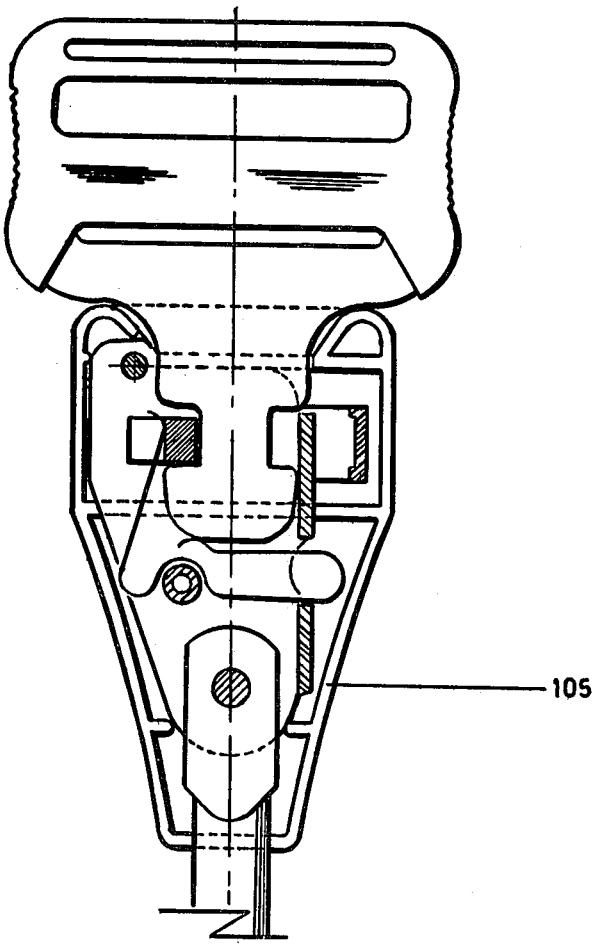
FIGS. 21, 22 and 23 show the belt lock with the slide-in tongue locked, and various possible methods of connecting the lock to the belt.
Figure 22:
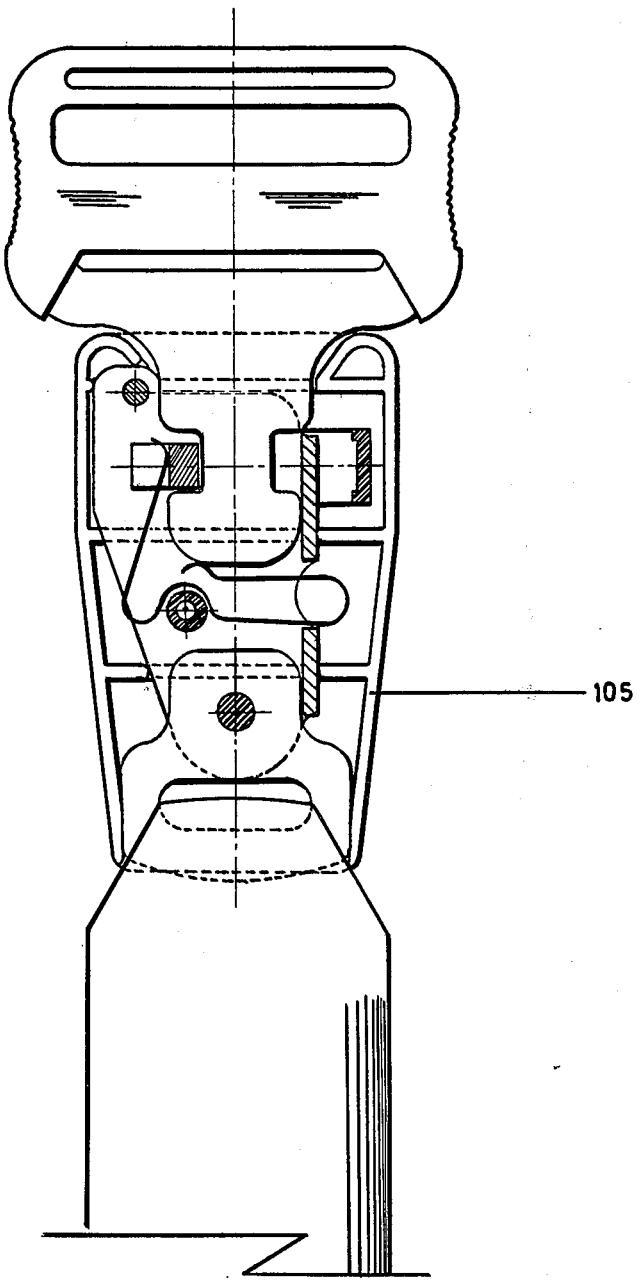
Figure 23:
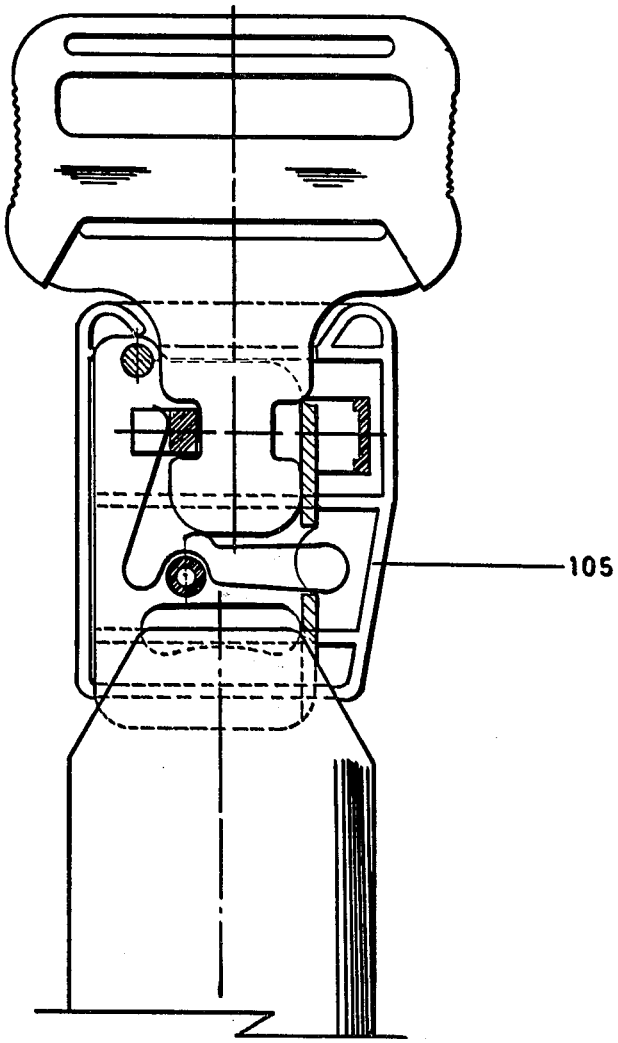

FIGS. 21, 22 and 23 are provided simply to illustrate some possible ways of attaching the belt lock to the floor of the vehicle. In FIG. 21 the housing 105 is shown as been narrower towards the bottom than is the case in the forms illustrated in FIGS. 22 and 23, since in the FIG. 21 arrangement attachment is effected with the aid of a cable secured to the floor of the vehicle. The wider form of the housing 105 in the other arrangements is for the purpose of enabling the lock to be secured to a belt which can likewise be attached to the seat or at some point on the vehicle chassis.

We claim:

1. A belt lock for a safety belt, especially a vehicle safety belt, having a housing in which is provided a push-button for actuating a spring-biased bolt, there being provided in the housing at least one lock plate having a guide channel, the longitudinal axis of which extends transversely to the direction in which a plate-like slide-in tongue with lateral locking notches slides, the bolt being movable in the guide channel and being directly connected to a guide part, which has two limbs which are disposed on the outer faces of the lock plate and are firmly connected to the bolt, and the faces of, on the one hand, the locking notches on the slide-in tongue and of, on the other hand, the bolt, which bear against each other in the locking position, being disposed obliquely in relation to the longitudinal central axis of the slide-in tongue, characterized in that the push-button and the guide part are formed as two separate elements which are each provided with an inclined face which slopes towards the longitudinal axis of the guide channel, the inclined face on one of the elements being presented to the inclined face on the other.

2. A belt lock according to claim 1, characterized in that the guide part has, on that of its faces presented to the push-button, two walls which project from the limb, a narrow edge of each wall, that is disposed opposite the bolt, being formed as an inclined face.

3. A belt lock according to claim 1, characterized in that the push-button has two guide walls extending into the housing and disposed parallel to the longitudinal axis of the guide channel, between which walls is provided an inclined face which is additionally supported on the base of the push-button and which slopes towards the longitudinal axis of the guide channel.

4. A belt lock according to claim 1, characterized in that the guide part has, on that of its sides facing the push-button and in the zone where the bolt is secured, a ramp part which extends from the free end of the guide part to approximately the middle and which is delimited towards the middle by a face which is inclined with respect to both the longitudinal axis of the guide channel and the direction in which the slide-in tongue is inserted.

5. A belt lock according to claim 1, characterized in that the push-button is of substantially L-shaped cross-section and has on that of its sides facing the interior of the housing an arm having a wedge face which is sloped to correspond with the inclined face of the guide part.

* * * * *

UNITED STATES PATENT OFFICE

CERTIFICATE OF CORRECTION

Patent No. 4,033,015 Dated July 5, 1977

Inventor(s) Uwe Peters and Horst Minolla

It is certified that error appears in the above-identified patent and that said Letters Patent are hereby corrected as shown below:

First page, in the Inventors names "Peters Uwe" should read --Uwe Peters--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*